US009640918B2

(12) United States Patent
Tang et al.

(10) Patent No.: US 9,640,918 B2
(45) Date of Patent: May 2, 2017

(54) ELECTRICAL CONNECTOR HAVING A FLANGE

(71) Applicant: FOXCONN INTERCONNECT TECHNOLOGY LIMITED, Grand Cayman (KY)

(72) Inventors: Zhi-Hui Tang, Kunshan (CN); Zhi-Cheng Zhang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/045,160

(22) Filed: Feb. 16, 2016

(65) Prior Publication Data

US 2016/0164231 A1 Jun. 9, 2016

Related U.S. Application Data

(63) Continuation of application No. 13/962,147, filed on Aug. 8, 2013, now Pat. No. 9,263,834.

(30) Foreign Application Priority Data

Aug. 8, 2012 (CN) ..... 2012 1 0279913

(51) Int. Cl.

| | |
|---|---|
| ***H01R 13/6591*** | (2011.01) |
| ***H01R 13/46*** | (2006.01) |
| ***H01R 13/6596*** | (2011.01) |
| ***H01R 13/6581*** | (2011.01) |
| ***H01R 24/64*** | (2011.01) |
| ***H01R 13/74*** | (2006.01) |

(52) U.S. Cl.

CPC ..... *H01R 13/6591* (2013.01); *H01R 13/46* (2013.01); *H01R 13/6581* (2013.01); *H01R 13/6596* (2013.01); *H01R 13/74* (2013.01); *H01R 13/745* (2013.01); *H01R 24/64* (2013.01)

(58) Field of Classification Search

CPC ..... H01R 13/6596; H01R 13/6591

See application file for complete search history.

(56) References Cited

U.S. PATENT DOCUMENTS 5,083,945 A * 1/1992 Miskin ..... H01R 13/65802 439/108

5,195,911 A * 3/1993 Murphy ..... H01R 13/65802 439/607.53

(Continued)

*Primary Examiner* — James Harvey

(74) *Attorney, Agent, or Firm* — Wei Te Chung; Ming Chieh Chang

(57) ABSTRACT

An electrical connector includes an insulative housing, a shell covering the insulative housing, and a flange mounted to the shell. The insulative housing has a front face, a number of outer faces, and a receiving cavity extending through the front face for receiving a mating connector. The shell has a front wall and a number of outer walls covering the housing front and outer faces, respectively. The flange has a mating sleeve mounted to the shell and a mating flange portion for engaging a panel along a front-to-back direction. The mating sleeve is bent from a material band, and the mating flange portion is bent from the mating sleeve. The mating flange portion is substantially perpendicular to and resiliently flexible relative to the mating sleeve.

20 Claims, 6 Drawing Sheets

(56) References Cited

U.S. PATENT DOCUMENTS

| | | | | |
|---|---|---|---|---|
| 6,478,622 | B1 * | 11/2002 | Hwang | H01R 13/65802 385/92 |
| 7,322,854 | B2 * | 1/2008 | Long | H01R 13/65802 439/607.28 |
| 2008/0171469 | A1 * | 7/2008 | Phillips | H01R 13/6582 439/607.01 |
| 2012/0115364 | A1 * | 5/2012 | Han | H01R 13/6594 439/607.55 |
| 2013/0224998 | A1 * | 8/2013 | Feldstein | H01R 13/6596 439/607.01 |
| 2014/0045374 | A1 * | 2/2014 | Tang | H01R 13/6581 439/569 |
| 2014/0099822 | A1 * | 4/2014 | Duesterhoeft | H01R 13/6583 439/607.02 |

* cited by examiner

ELECTRICAL CONNECTOR HAVING A FLANGE

This application is a continuation application of U.S. Pat. No. 9,263,834 to be issued on Feb. 16, 2016.

BACKGROUND OF THE INVENTION

1. Field of the Invention

The present invention relates to an electrical connector, and more particularly to an electrical connector having a flange disposed outside a metallic shell for further engaging with a device panel.

2. Description of Prior Arts

U.S. Pat. No. 7,322,854 issued to Long et al. on Jan. 29, 2008 discloses a spring-biased EMI shroud that completely encircles a metal shielding cage. The shroud has an opening that is surrounded by a plurality of sides having first and second flanges, which respectively contact the inner surface of a device faceplate and the exterior surfaces of the shielding cage. A pair of spring arms are provided in order to apply a forward biasing force against the shroud, thereby forcing it into contact with the faceplate. The spring arm includes a torsion loop engaging the shielding cage. The shroud is generally stamped out of a sheet metal with the first and second flanges bent to extend backwardly so that the side forms a general U- or V-shape.

U.S. Pat. No. 6,478,622 issued to Hwang on Nov. 12, 2002 discloses a single piece EMI shroud or device including a top cover or wall, a bottom plate or wall opposite to the top wall, and a first and second side walls. Discrete outward fingers are integrally formed on the walls.

An electrical connector having a different shielding structure is desired.

SUMMARY OF THE INVENTION

An electrical connector includes: an insulative housing including a front face, a plurality of outer faces perpendicular to the front face, and a receiving cavity extending from the front face along a front-to-back direction for receiving a mating connector; a shell including a front wall covering the front face and a plurality of outer walls covering the outer faces; and a flange including a mating sleeve and a mating flange portion bent from an edge of the mating sleeve for engaging a panel, the mating sleeve mating with the outer walls of the shell, the mating sleeve including a first mating wall, a second mating wall bent from the first mating wall, and a third mating wall bent from the second mating wall, the flange portion including a first portion, a second portion, and a third portion substantially perpendicular to and flexible relative to a respective mating wall of the mating sleeve.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
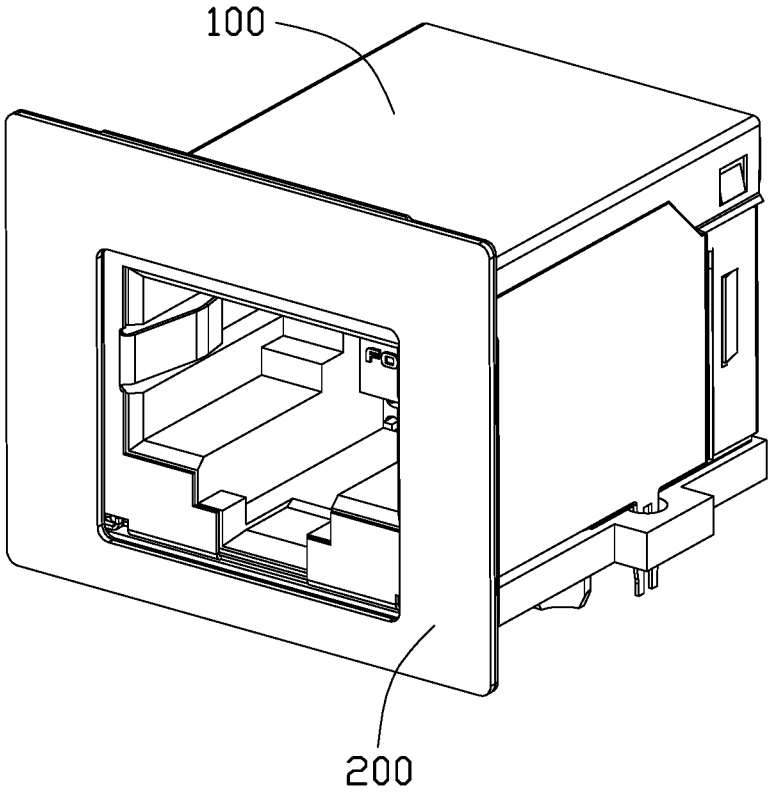
FIG. 1 is a perspective view of an electrical connector in accordance with the present invention which interacts with a panel.

Reference will now be made to the drawing figures to describe the present invention in detail.

Figure 2:
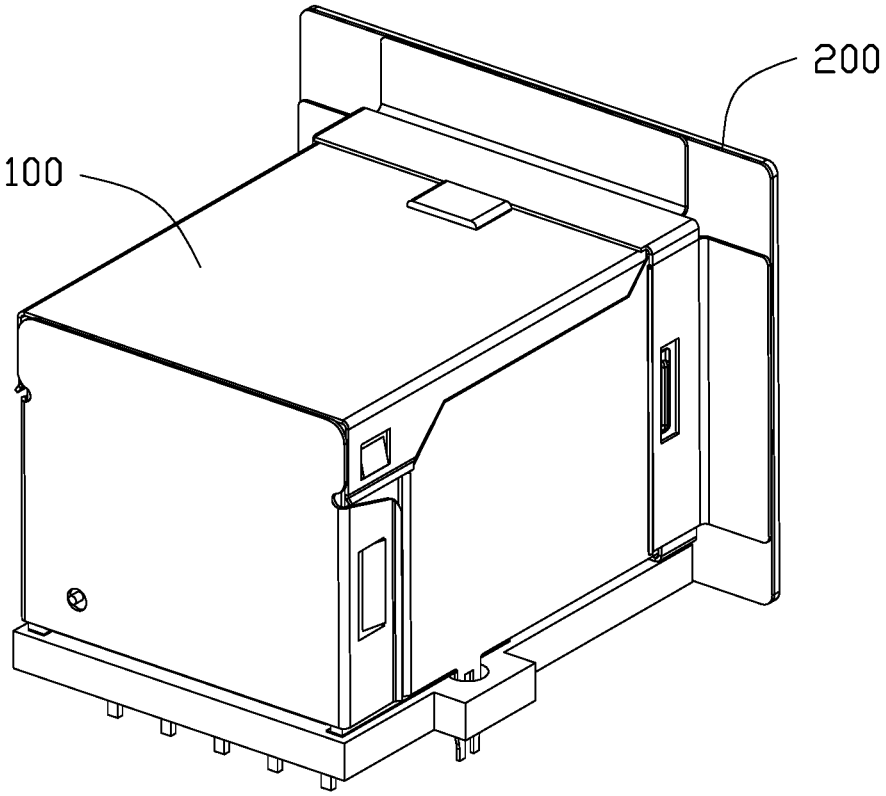
FIG. 2 is another view of the electrical connector and the panel as shown in FIG. 1.
Figure 3:
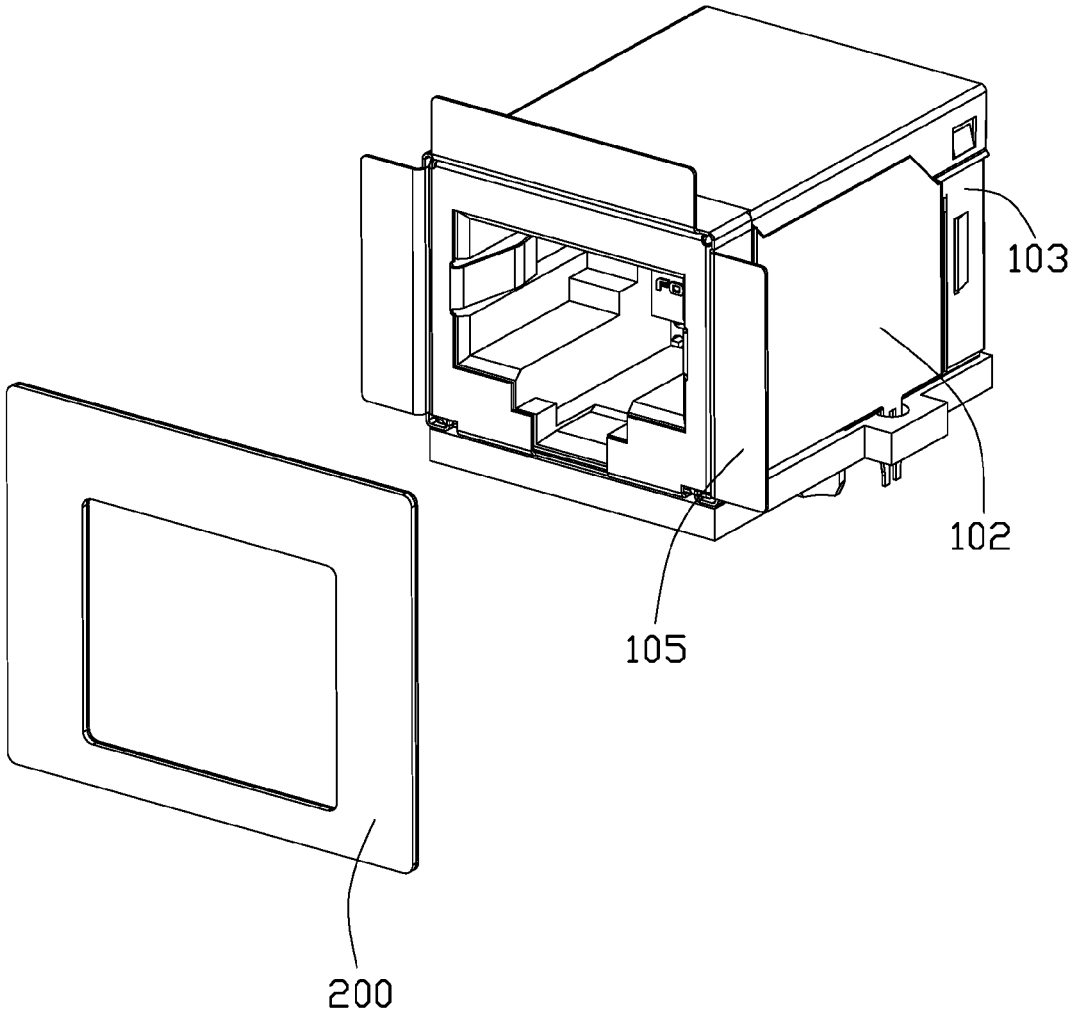
FIG. 3 is a view similar to FIG. 1 but with the electrical connector distanced from the panel.
Figure 4:
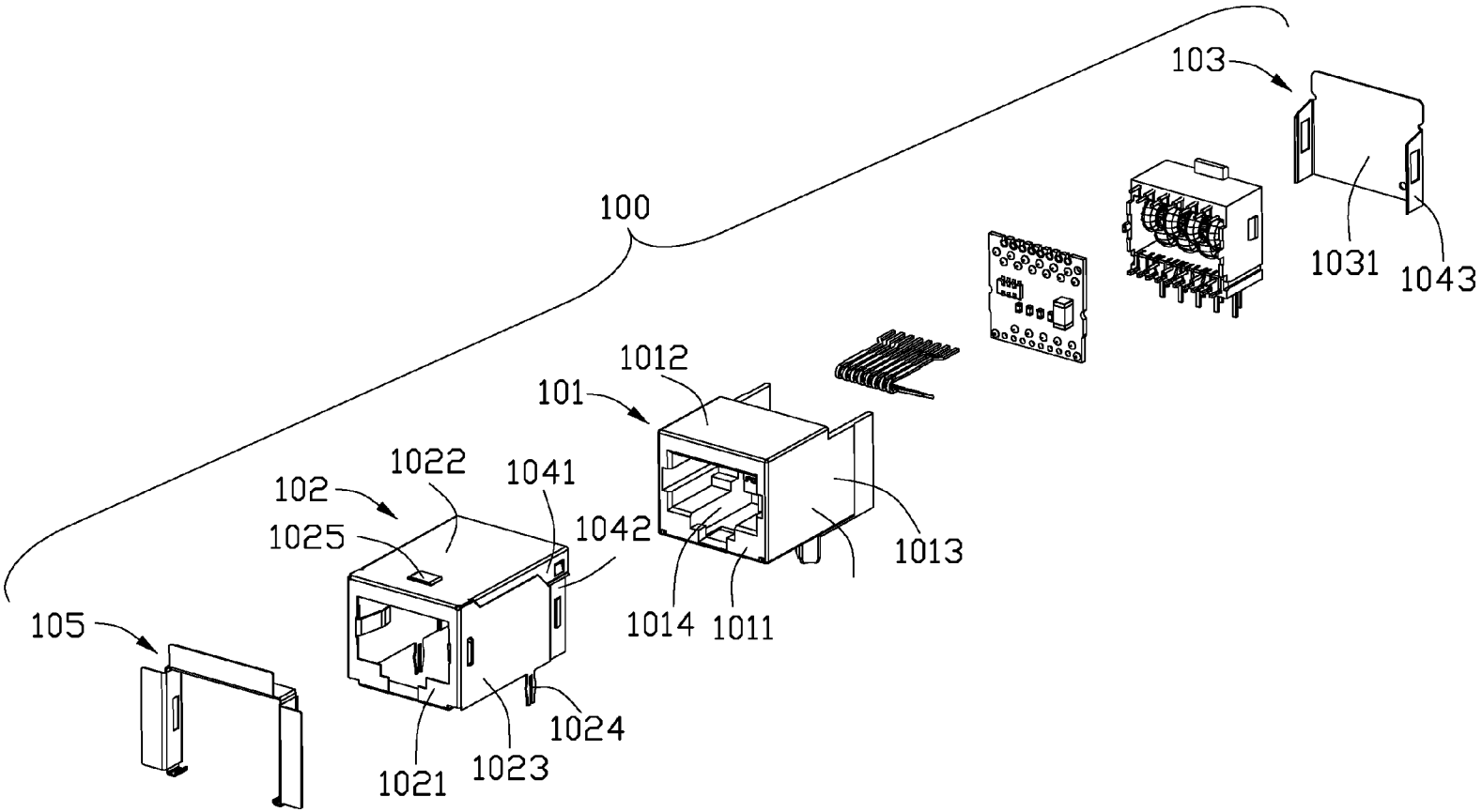
FIG. 4 is an exploded view of the electrical connector in FIG. 3.
Figure 5:
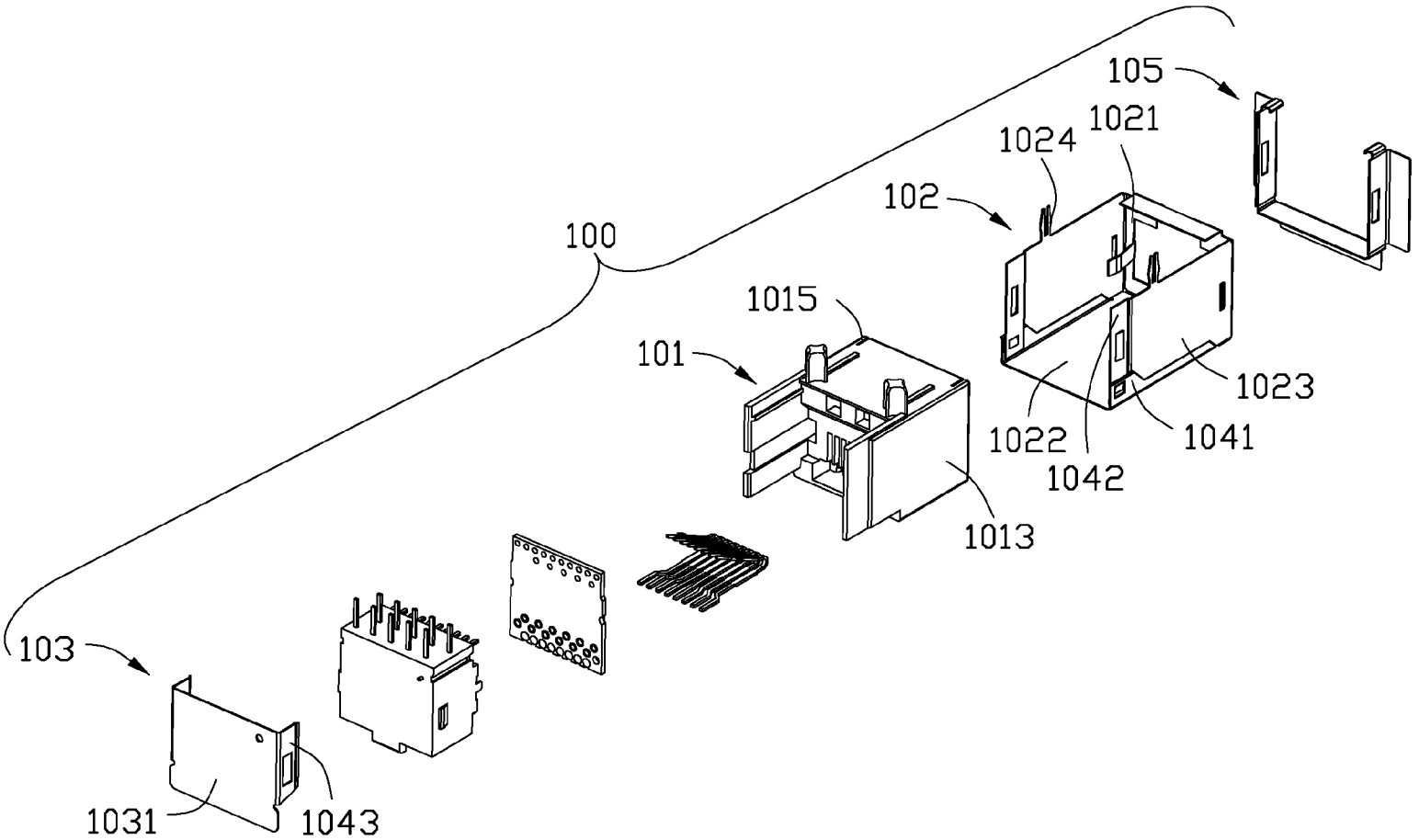
FIG. 5 is another exploded view of the electrical connector.
Figure 6:
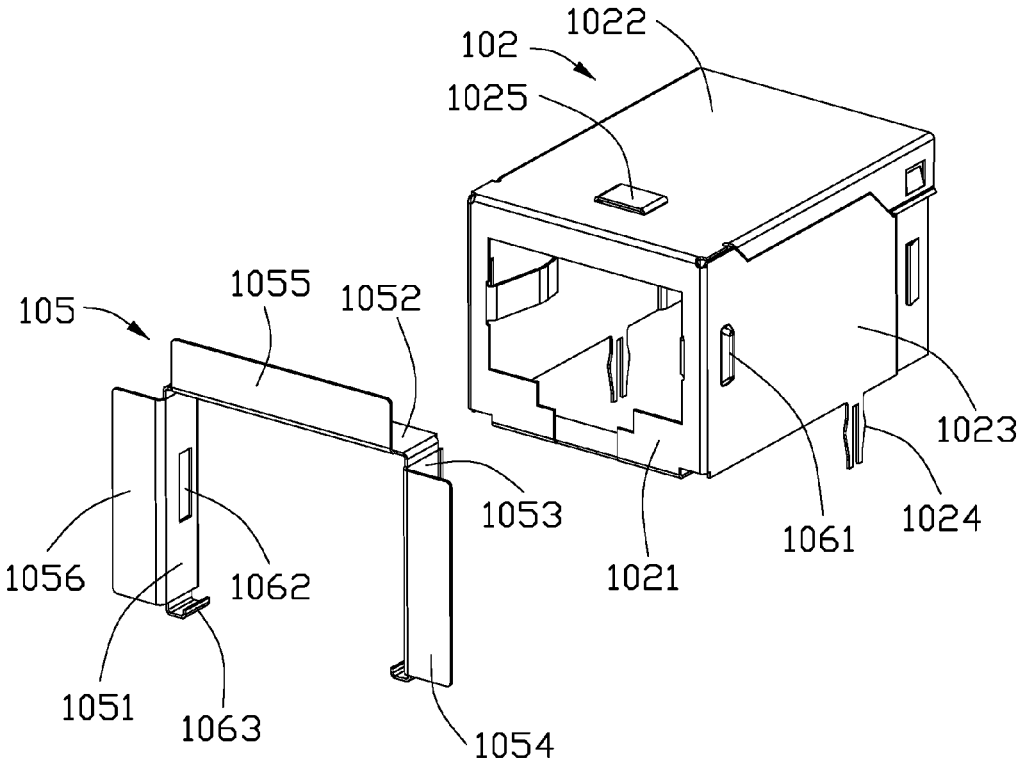
FIG. 6 is a detailed view of the shell and the flange in FIG. 4.

FIGS. 1-3 show an electrical connector 100 and a panel 200 (only part being shown for simplicity) having a passage for admitting a mating electrical connector. The electrical connector 100 includes an insulative housing 101, a shell covering the insulative housing 101, and a flange 105 disposed outside of the shell. The insulative housing 101 includes a front face 1011, a plurality of outer faces perpendicular to the front face 1011, and a receiving cavity 1014 extending from the front face 1011 along a front-to-back direction for receiving a mating connector. The shell includes a front shell 102 and a rear shell 103. The front shell 102 includes a front wall 1021 covering the front face 1011 and a plurality of outer walls covering the outer faces. The outer walls are bent from the front wall 1021 perpendicularly, and the outer walls include a upper wall 1022 and two corresponding side walls 1023. The upper wall 1022 defines two first locking sections 1041 extending from two corresponding side edges of the upper wall 1022 along an up-to-down direction. The two corresponding side walls 1023 each define a second locking section 1042 extending from the rear edge of the two corresponding side walls 1023 along a front-to-back direction. The rear shell 103 includes a rear wall 1031 and two third locking sections 1043 each extending from the side edge of the rear wall 1031 along a back-to-front direction. The third locking section 1043 latches the second locking section 1042, and the first locking section 1041 of the upper wall 1022 latches the second locking section 1042. The upper wall 1022 of the front shell 102 includes a positioning portion 1025, and the positioning portion 1025 is used for mating with the flange 105. The positioning portion 1025 prevents the flange 105 from moving backwards.

The flange 105 includes a mating sleeve. The mating sleeve includes a first mating wall 1051, a second mating wall 1052 bent from the first mating wall 1051, and a third mating wall 1053 bent from the second mating wall 1052. The first mating wall 1051 and the third mating wall 1053 mate with two corresponding side walls 1023 of the front shell 102, and the second mating wall 1052 mates with the upper wall 1022 of the front shell 102. Respective bottom edge of the first mating wall 1051 and the third mating wall 1053 each include a guiding hook 1063, and the insulative housing 101 includes two short slots 1015 at a bottom surface. The guiding hook 1063 mates with the short slot 1015 and prevents the flange 105 from opening outward. Each of the first mating wall 1051 and the third mating wall 1053 includes a locking slot 1062, and each of two corresponding side walls 1023 of the front shell 102 includes a locking block 1061. The locking slot 1062 mates with the locking block 1061. The flange 105 also includes a mating flange portion, and the mating flange portion is bent from an edge of the mating sleeve perpendicularly for engaging the panel 200. The mating flange portion includes a first portion 1054 substantially perpendicular to and flexible relative to the mating wall 1053, a second portion 1055 substantially perpendicular to and flexible relative to the mating wall 1052, and a third portion 1056 substantially perpendicular to and flexible relative to the mating wall 1051. Viewed as a whole, the flange portion is substantially perpendicular to the outer walls of the front shell 102. The mating flange portion is used for engaging the panel 200 resiliently. Depending on practical needs, the mating flange portion after mounting onto the front shell 102 can protrude beyond the front wall 1021 of the front shell 102, be in substantially same plane with the front wall 1021, or even be situated behind the front wall 1021.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a front face, a plurality of outer faces perpendicular to the front face, and a receiving cavity extending from the front face along a front-to-back direction for receiving a mating connector;

a shell including a plurality of outer walls covering the outer faces; and a flange defining an upside-down U-shaped configuration in a front view, and including a mating sleeve and a mating flange portion bent from an edge of the mating sleeve for engaging a panel, the mating sleeve located outside of the outer faces and including a first mating wall, a second mating wall bent from the first mating wall, and a third mating wall bent from the second mating wall, the flange portion including a first portion extending from the first mating wall, a second portion extending from the second mating wall, and a third portion extending from the third mating wall, wherein said first portion, said second portion and said third portion are substantially perpendicular to and flexible relative to the corresponding respective first mating wall, second mating wall and third mating wall of the mating sleeve.

2. The electrical connector as claimed in claim 1, wherein said mating flange portion protrudes beyond the front face of the housing.

3. The electrical connector as claimed in claim 1, wherein said mating flange portion is located around the front face of the housing.

4. The electrical connector as claimed in claim 1, wherein the outer walls including two side walls and an upper wall.

5. The electrical connector as claimed in claim 4, wherein said shell includes a front shell and a rear shell, the front shell including said front wall and said outer walls.

6. The electrical connector as claimed in claim 4, wherein said upper wall comprises a positioning portion mating with the flange.

7. The electrical connector as claimed in claim 4, wherein said first mating wall and said third mating wall corresponding to said two side walls of the shell in a front-to-back direction, a respective bottom edge of each of the first mating wall and the third mating wall has a guiding hook, and the insulative housing has two slots at a bottom surface thereof receiving the corresponding guiding hooks, respectively.

8. The electrical connector as claimed in claim 4, wherein each of said first mating wall and said third mating wall has a locking slot, and each of said two side walls of the shell has a locking block latching said locking slot.

9. An electrical connector comprising:

an insulative housing having rectangular body defining a front face surrounded by opposite top and bottom faces and two opposite lateral side faces with a mating cavity therein;

a metallic shell securely enclosing said housing and defining opposite lateral side walls and a top wall therebetween corresponding to the two opposite lateral side faces and the top face, respectively;

a unitary metallic flange discrete from the shell, forming an upside-down U-shaped configuration in a front view, and defining a mating sleeve including a top section and two opposite lateral sections to be conformably located outside of front portions of said top face and two opposite lateral side faces of the housing, respectively, and further defining a mating flange including an upper flange and two opposite side flanges respectively unitarily extending forwardly from corresponding front edges of the top section and the two opposite lateral sections for forward abutment with an external panel; wherein each of the lateral sections of the flange forms a locking slot therein for locking to at least one of said shell and said housing, and at a bottom edge thereof a guiding hook received within a corresponding narrow slot formed in said bottom face of the housing.

10. The electrical connector as claimed in claim 9, wherein said shell further defines a bottom wall around the front face of the housing, and said bottom wall is spaced from the two opposite lateral side walls to allow the corresponding guiding hooks to pass therethrough for engagement within the corresponding slots in the bottom face of the housing.

11. The electrical connector as claimed in claim 9, wherein said mating sleeve is overlapped upon the shell.

12. The electrical connector as claimed in claim 9, wherein said shell further includes a rear wall having two lateral sides locked with the corresponding lateral side walls, respectively.

13. The electrical connector as claimed in claim 9, wherein each of said guiding hook forms a U-shaped configuration in the front view.

14. An electrical connector comprising:

an insulative housing having rectangular body defining a front face surrounded by opposite top and bottom faces and two opposite lateral side faces with a mating cavity therein;

a metallic shell securely enclosing said housing, forming an upside-down U-shaped configuration in a front view, and defining opposite lateral side walls and a top wall therebetween corresponding to the two opposite lateral side faces and the top face, respectively;

a unitary metallic flange discrete from the shell and defining a mating sleeve including a top section and two opposite lateral sections to be conformably located outside of front portions of said top wall and two opposite lateral side faces of the housing, respectively, and further defining a mating flange including at least one flange unitarily extending forwardly from a front edge of at least one of said top section and said two opposite lateral sections for forward abutment with an external panel; wherein said flange includes means for latching to at least one of the shell and the housing; wherein said means includes a pair of guiding hooks unitarily formed on bottom ends of the corresponding lateral sections, respectively, to be engaged within corresponding narrow slots formed in the bottom face of the housing.

15. The electrical connector as claimed in claim 14, wherein each of said guiding hooks forms an upstanding U-shaped configuration.

16. The electrical connector as claimed in claim 14, wherein said shell further defines a bottom wall around the front face of the housing, and said bottom wall is spaced from the two opposite lateral side walls to allow the corresponding guiding hooks to pass therethrough for engagement within the corresponding slits in the bottom face of the housing.

17. The electrical connector as claimed in claim 14, wherein said means includes an opening structure for securing.

18. The electrical connector as claimed in claim 17, wherein a protrusion is formed on the shell to be received within the opening.

19. The electrical connector as claimed in claim 14, wherein said narrow slot forwardly communicates with an exterior so as to allow the flange to be assembled to a combination of said housing and said shell rearwardly from a front side of said housing.

20. The electrical connector as claimed in claim 14, wherein each of the lateral side walls forms a downwardly extending mounting leg behind the flange in a front-to-back direction.

* * * * *